United States Patent [19]

Boser et al.

[11] Patent Number: 4,660,821

[45] Date of Patent: Apr. 28, 1987

[54] METHOD OF AND APPARATUS FOR ATTACHING FLY STRIPS TO A SLIDE FASTENER CHAIN

[75] Inventors: Ronald J. Boser, Dix Hills, N.Y.; Michael T. Martin, Gainsville, Ga.

[73] Assignee: Yoshida Kogyo K.K., Tokyo, Japan

[21] Appl. No.: 760,968

[22] Filed: Jul. 31, 1985

Related U.S. Application Data

[62] Division of Ser. No. 502,310, Jun. 28, 1983, Pat. No. 4,541,352.

[51] Int. Cl.[4] ..... B65H 5/00; D05B 19/00; D05B 3/16

[52] U.S. Cl. ..... 271/10; 112/121.11; 112/265.2

[58] Field of Search ..... 112/121.11, 121.27, 112/265.2; 271/4, 10, 18, 18.3, 19, 21, 22, 31.1, 33, 109, 113, 121

[56] References Cited

U.S. PATENT DOCUMENTS

| | | | |
|---|---|---|---|
| 3,685,471 | 8/1972 | Reynolds | 112/265.2 X |
| 4,362,116 | 12/1982 | Sen Gupta et al. | 112/121.11 X |
| 4,441,438 | 4/1984 | Takahashi | 112/121.27 X |
| 4,541,352 | 9/1985 | Boser et al. | 112/265.2 |
| 4,561,365 | 12/1985 | Schmidt et al. | 112/121.27 |
| 4,562,782 | 1/1986 | Doncette et al. | 112/121.27 X |

*Primary Examiner*—Andres Kashnikow
*Assistant Examiner*—Robert J. Oberleitner

[57] ABSTRACT

Automatic assembly for sewing flypiece to a continuous slide fastener chain includes a sewing machine, a gapping device from which the continuous chain having element-free gaps formed at regular intervals therealong is fed to the sewing machine, and a flypiece delivery system for successively retrieving individual flypieces one at a time from a stack and successively advancing to the sewing machine. The flypiece delivery system is arranged such that successive flypieces are sewn to the fastener chain virtually even with the rate at which gapped chain is delivered from the gapping device.

8 Claims, 21 Drawing Figures

METHOD OF AND APPARATUS FOR ATTACHING FLY STRIPS TO A SLIDE FASTENER CHAIN

This is a division, of application Ser. No. 502,310, filed June 28, 1983, now U.S. Pat. No. 4,541,352.

BACKGROUND OF THE INVENTION

The present invention relates to the production of trouser closures for fly openings and, more particularly, to methods and apparatus for attaching successive trouser fly strips to a continuous slide fastener chain.

In the manufacture of trouser closures for fly openings, it has been known to feed successive fly strips to a sewing machine one after another by hand in timed relation to the automatic feed of a continuous slide fastener chain to the sewing machine. This known method is subject to human error and worker fatigue, typically causing inefficient and non-uniform attachment of the fly strips.

U.S. Pat. No. 4,362,116, discloses an apparatus in which successive fly strips are automatically supplied to a sewing machine by means of a conveyor; however, a workman's hand is still used to place the fly strips one after another on the conveyer. Further, in the apparatus according to the U.S. Pat. No. 4,362,116 successive fly strips are attached to a continuous slide fastener chain before element-free gaps are provided in the fastener chain. To provide the element-free gaps in the fastener chain after the successive fly strips have been attached thereto, not only retards the rate of production, but also enables the threads of fly strips to be frayed or otherwise damaged during the element-free gap forming operation. This fraying of such threads impairs following peripheral operations, such as threading sliders, attaching end stops and even sewing individual prospective trouser closures to trousers.

Another disadvantage of the apparatus according to U.S. Pat. No. 4,362,116, is that the successive fly strips and the fastener chains must always be fed in one and the same direction for a fixed attachment orientation. It is impossible to adjust the feeding direction of the successive fly strips with respect to the feeding direction of the fastener chain to enable production of pieces in which the individual fly strips are variously oriented as attached to the fastener chain.

The present invention represents a significant advance in the art by providing a method and apparatus for full-automatically attaching successive fly strips to a continuous slide fastener chain, irrespective of the presence of element-free gaps in the fastener chain or the desired orientation of the individual fly strips with respect to the fastener chain.

SUMMARY OF THE INVENTION

An automated assembly for sewing fly strips onto a continuous fastener chain comprises a sewing machine, a fly strip delivery system for automatically supplying successive fly strips one after another to the sewing machine, and a gap forming unit for forming element-free gaps in the chain at a uniform interval and for feeding the gapped fastener chain to the sewing machine. A control sensor for detecting the presence of a gap in the chain being fed to the sewing machine serves to trigger recycling of the fly strip delivery system.

The fly strip delivery system is arranged for quick, reliable advancing of successive fly strips to the sewing machine for relatively uninterrupted fly strip attachment to continuous chain. This is brought about by a unique system of indexed movement of successive individual fly strips obtained from a stack supply wherein, one immediately following only one step behind the other, a fly strip is: (1) withdrawn from the face of a stack and delivered flat onto a horizontal first table in a consistent manner and orientation, (2) laterally advanced from the first table onto the upper surface of a two-tiered second table defined by transversely reciprocating, opposed upper table surface halves into the sewing station directly beneath the chain and dropped through the opening formed by the mutual retraction of the upper table surfaces onto a lower second table surface, and (3) drawn from the lower table surface into the sewing machine together with the chain for attachment with the upper table halves having closed behind it to receive the next individual fly strip. The fly strip delivery system is adapted to work with fly strip stacks of the alternating type, such as conventionally occurs in jean parts.

The inventive assembly enables the successive fly strips to be sewn to the fastener chain virtually simultaneously with the gapping and also provides for a transversely adjustable mounting of the fly strip delivery system relative to the feed direction of the chain to permit varying orientation in the attachment of fly strip and chain.

Other inventive features, objects and advantages to the present invention will become apparent to those skilled in the art from the detailed description below of a preferred embodiment.

DESCRIPTION OF THE PREFERRED EMBODIMENT

Figure 1:
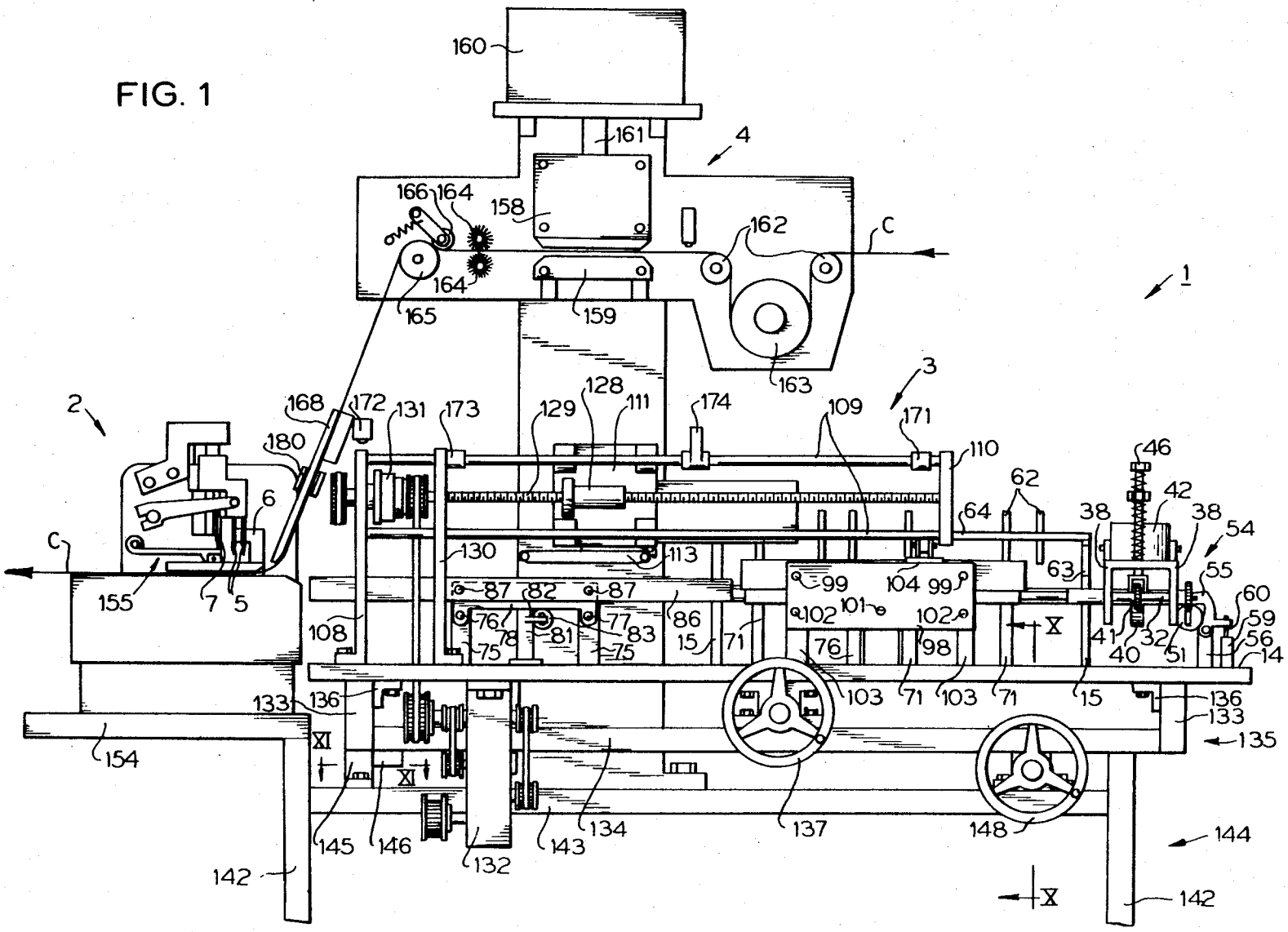
FIG. 1 is a front elevational view of an automatic fly-strip attaching apparatus embodying the present invention.
Figure 2:
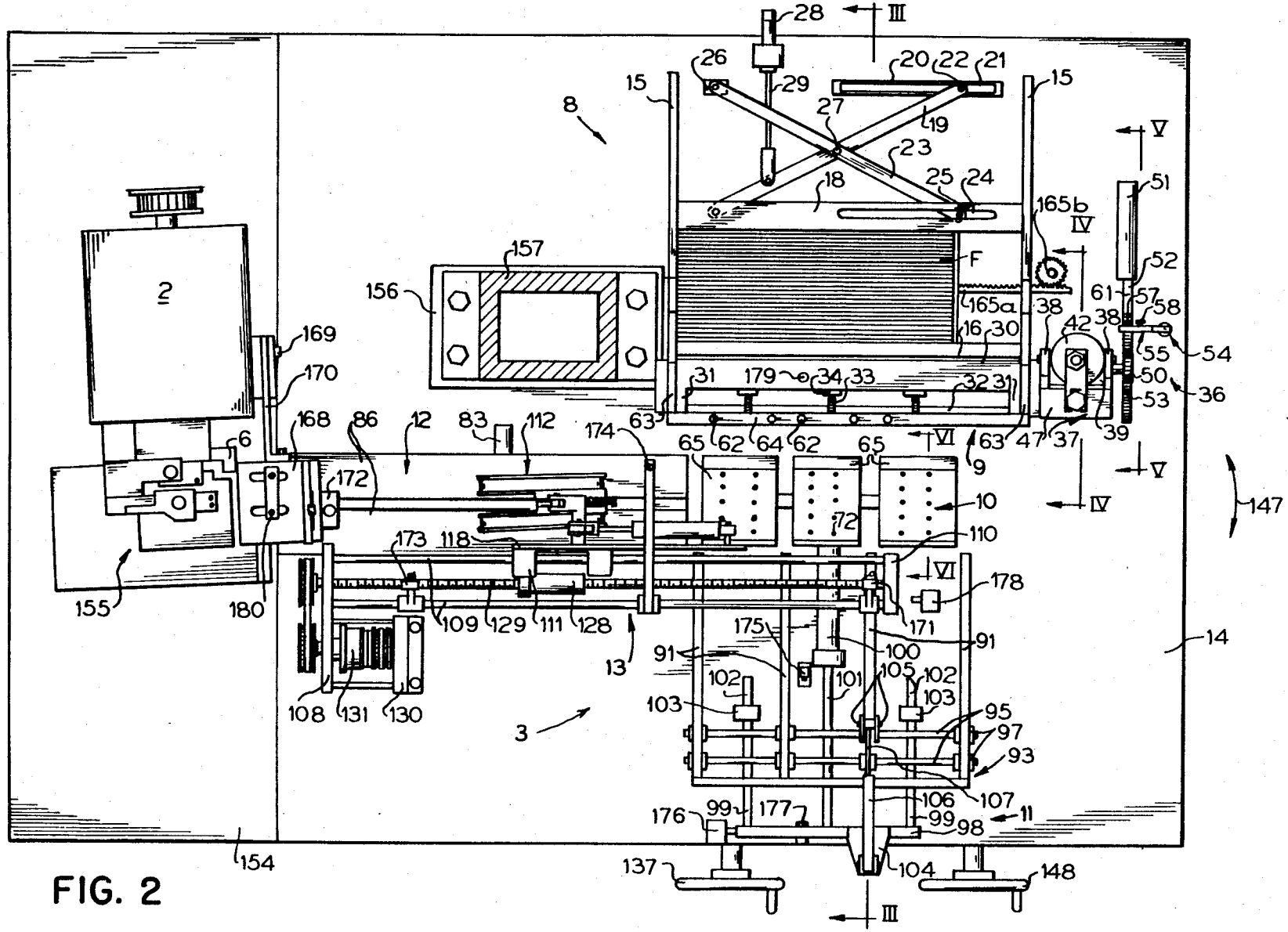
FIG. 2 is a plan view of the apparatus of FIG. 1.
Figure 3:
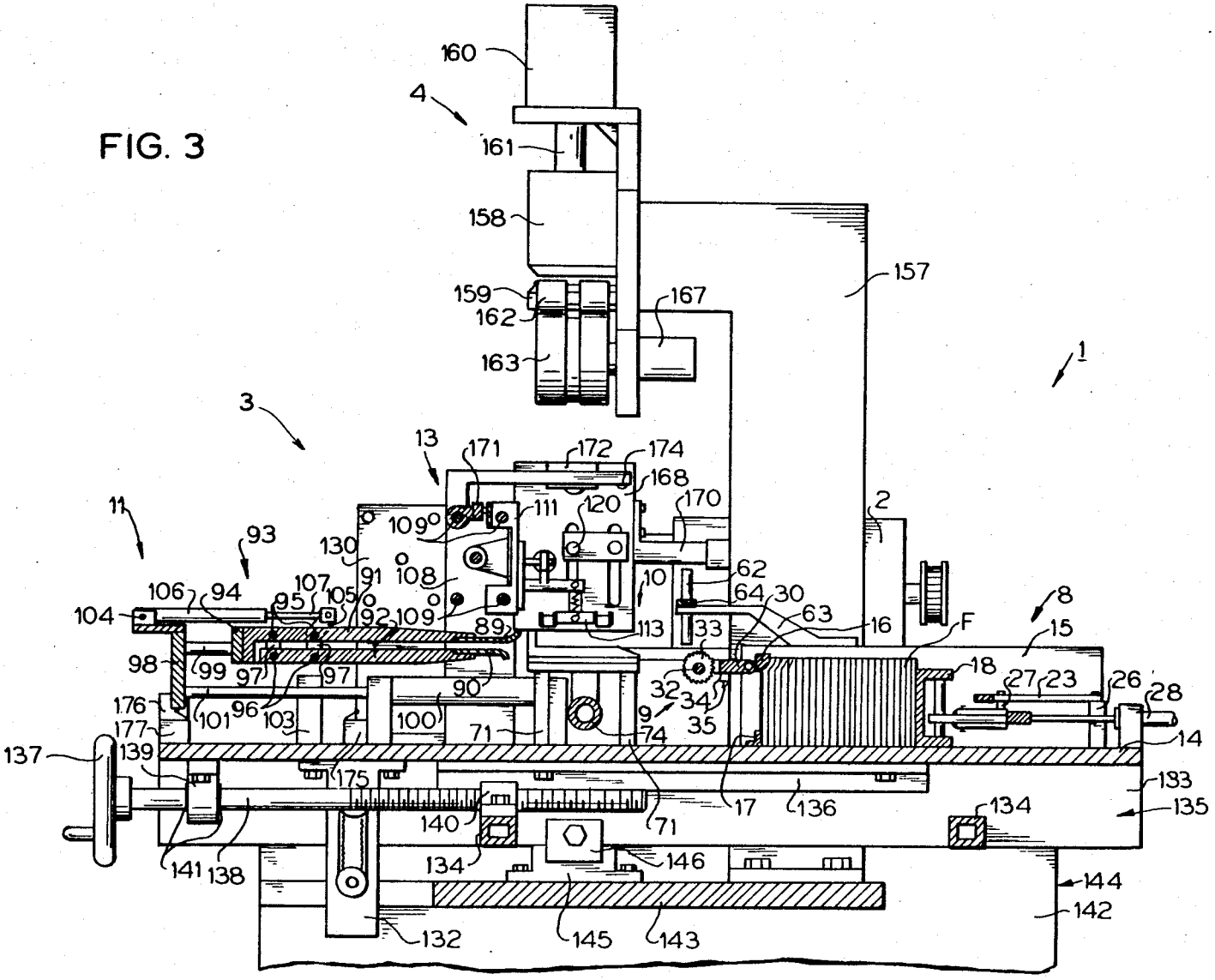
FIG. 3 is a cross-sectional view taken along line III—III of FIG. 2.

As shown in FIGS. 1-3, an automatic apparatus 1 for attaching successive fly strips or fly pieces F one after another to a continuous slide fastener chain C in accordance with the invention generally may comprise a sewing machine 2, a fly-strip supplier 3 for automatically supplying the successive fly strips one after another to the sewing machine 2, and an element-free gap forming unit or gapper 4 for forming element-free gaps in the fastener chain C at a uniform interval of a predetermined distance and for feeding the gapped fastener chain C to the sewing machine 2.

The sewing machine 2 may be a conventional type on the market. It includes a pair of needles 5 for sewing the fly strips F to the fastener chain C, a cutter 6 for trimming one longitudinal edge of the individual fly strip F, and a needle 7 for overcasting the trimmed longitudinal edge of the individual fly strip F. The details of the sewing machine 2 itself are not pertinent here and its detailed description is omitted for clarity.

With reference to FIG. 2, the fly-strip supplier 3 includes a fly-strip stacker 8, a picker assembly 9 for picking up the fly strips F one after another from the stacker 8, a first feeder 11 for receiving the fly strips F from the picker assembly 9 and for feeding the fly strips F to a first feed table 10, and a second feeder 13 for feeding the fly strips F from the first feed table 10 to the sewing machine 2 via a second feed table 12.

As shown in FIGS. 2 and 3, the fly-strip stacker 8 includes a laterally spaced pair of side plates 15 mounted on a table 14 and connected at their front end by vertically spaced upper and lower stop bars 16, 17. A pusher bar 18 of C-shaped cross-section is disposed between the side plates 15 and is slidable on the table 14. A link 19 is pivotally connected at one end to one end of the pusher bar 18, and has at the other end a pin 22 slidably received in a slot 21 of a guide 20 fixed on the table 14. A link 23, which has the same length as the link 19, is pivotally connected at one end to a block 26 mounted on the table 14 in opposite relation to the guid 20, and has at the other end a pin 25 slidably received in a slot 24 in the other end of the pusher bar 18. The two links 19, 23 are pivotally corrected at the center to one another in vertically spaced relation by means of a stepped pin 27. A reciprocable piston rod 29 extends from a pneumatic cylinder 28 mounted on the table 14, and is pivotally connected at its free end to the link 19 at a position between one end of the link 19 and the stepped pin 27. As the piston rod 29 is extended, the pusher bar 18 is moved forwardly in the fly-strip stacker 8 in parallel relation to the upper and lower stop bars 16, 17 to push a stacked row of fly strips F against the upper and lower stop bars 16, 17. As the piston rod 29 is retracted, the pusher bar 18 is moved backwardly in the fly-strip stacker 8.

The picker assembly 9, shown in FIGS. 2–3, is pivotally connected to the fly-strip stacker 8 at a front upper portion thereof. The picker assembly 9 extends between the two side plates 15 and has a swing plate or arm 30 pivotally connected at opposite ends to the respective side plates 15. A pair of journals 31 is mounted on opposite ends of the swing plate or arm 30 and extends forwardly therefrom, a shaft 32 being rotatably supported on the journals 31. Three serrate picker wheels 33 are concentrically mounted on the shaft 32 and are spaced at equal distances along the shaft 32. Three picker pieces 34, each having on its lower end a claw 35, are mounted on the swing plate 30 in opposite relation to the three picker wheels 33, respectively, so that the pieces 34 cooperate with the picker wheels 33 to pick up individual fly-strip F therebetween.

Figure 4:
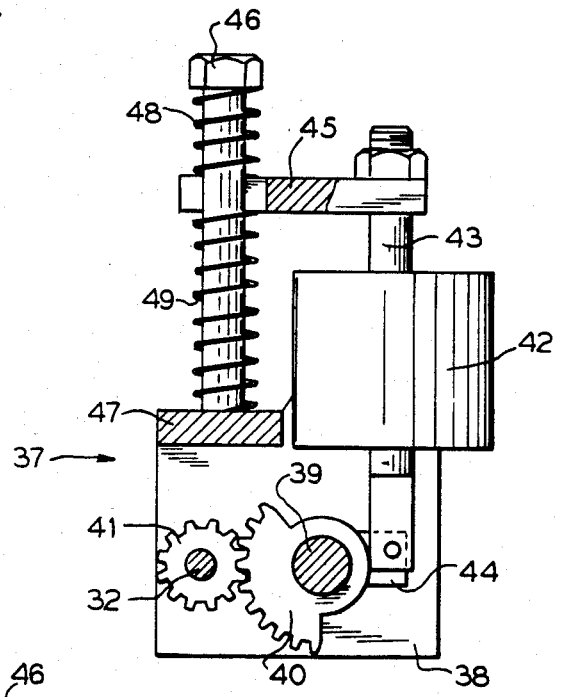
FIGS. 4, 5 and 6 are cross-sectional views taken along lines IV—IV, V—V and VI—VI, respectively, of FIG. 2.

A drive unit 36, shown in FIGS. 1, 2, and 4, of the picker assembly 9 includes a pivotable housing 37 secured to the right end of the swing plate 30. The housing 37 has a pair of side plates 38 between which a shaft 39 is fixed. A geneva or sector gear 40 is rotatably mounted on the shaft 39. The rotatable shaft 32 extends between the two side plates 38 through the journals 31, and is rotatably supported thereby. A small gear 41 is fixed to the rotatable shaft 32 and meshes with the geneva gear 40. On the housing 37, a pneumatic cylinder 42 is mounted between the two side plates 38. A piston rod 43 vertically extends through the pneumatic cylinder 42 and is pin connected at its lower end to a projection 44 of the geneva gear 40. A lateral arm 45 having a bifurcated end portion is mounted on the upper end of the piston rod 43. A bolt 46 extends through the arm 45 at the bifurcated end portion and then threadedly extends into a plate 47 connecting the two side plates 38. Around the bolt 46 a pair of compression springs 48, 49 is mounted between the head of the bolt 46 and the arm 45 and between the latter and the plate 47, respectively. Accordingly when the piston rod 43 of the pneumatic cylinder 42 is moved upwardly or downwardly, the shaft 32 and thus the picker wheel 33 rotates clockwise or counterclockwise, respectively.

Figure 5:
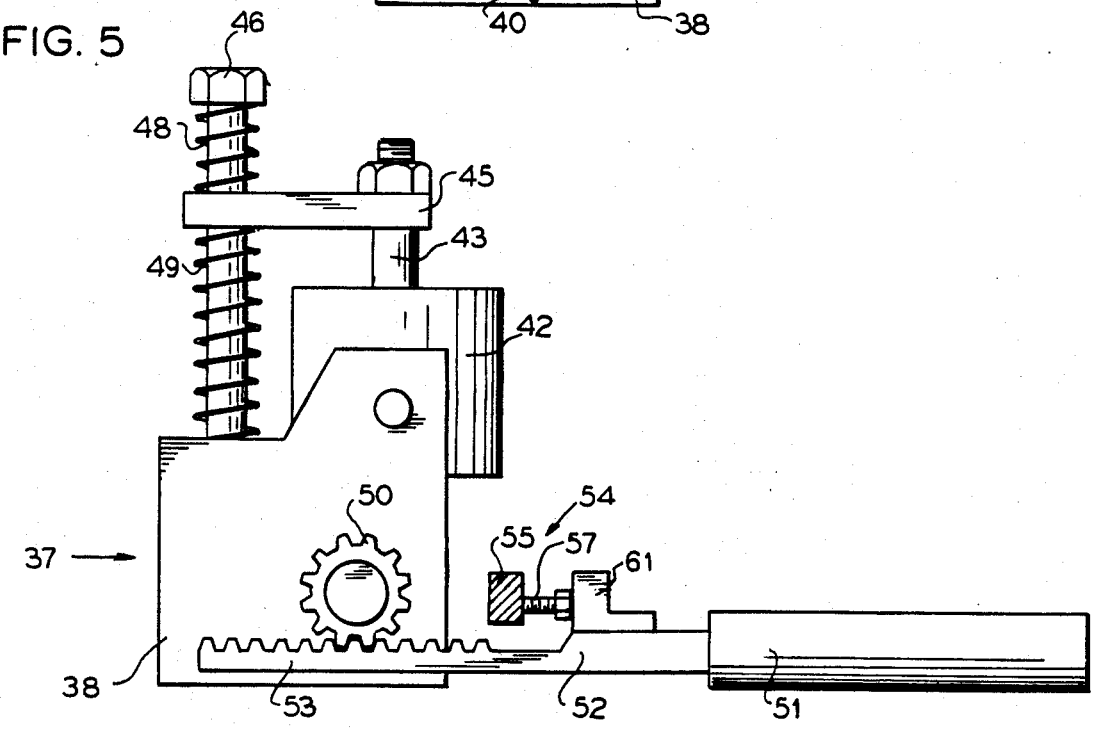

As shown in FIGS. 1, 2, and 5, on the outer surface of the one of the side plates 38, there is a gear 50 mounted about the fixed shaft 39 about which axis the swing plate 30 is also pivotable. The gear 50 is fixed to the side plate 38 and meshes with a rack 53 supported by the piston rod 52 of the pneumatic cylinder 51 mounted on the table 14. Accordingly, when the piston rod 52 is extended, the swing plate 30 is pivotally moved upwardly and to the contrary, when the piston rod 52 is retracted, the swing plate 30 is pivotally moved downwardly. A top mechanism 54 is disposed adjacent to the piston rod 52 in order to restrict the extent to which the piston rod 53 is extended, thus restricting the amoung of upward pivotal movement of the swing plate 30 for a purpose described below. The stop mechanism 54 has a lever 55 pivotally mounted on the upper portion of a bracket 56 mounted on the table 14. The lever 55 carries on one end two stop bolts 57, 58 of different lengths threadedly extending into the lever 55. The other end of the lever 55 is pivotally connected to the piston rod 60 of the pneumatic cylinder 59. Upon shrinkage of the piston rod 60 the long stop bolt 57 abuts a stop block 61 mounted on the piston rod 52 of the pneumatic cylinder 51. Reversely, upon extension of the piston rod 60, the short stop bolt 58 abuts the stop block 61.

In front of and above the picker assembly 9, a predetermined number of stop pins 62 are held in an upright frame including spaced brackets 63 fixed to the upper portions of the two side plates 15 and also by a crossbar or bridge plate 64 extending between the two brackets 63.

Figure 6:
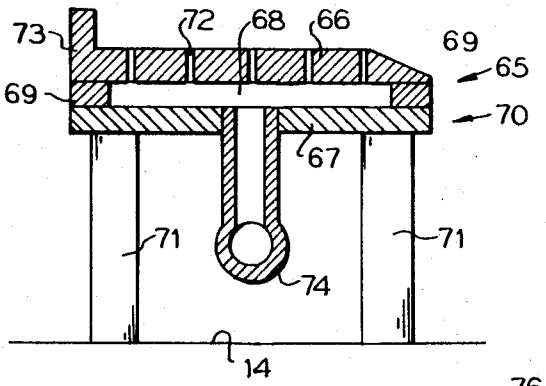

As shown in FIGS. 2, 3, and 6, the first feed table 10 comprises three spaced table members 65 supported on the table 14 in front of the picker assembly 9 and in parallel relation thereto, each table member 65 including a horizontal plate assembly 70. The horizontal plate assembly 70 comprises an upper plate 66, a lower plate 67, and a packing rubber 69 disposed between the upper and lower plates 66, 67 defining therebetween an air chamber 68. Each horizontal plate assembly 70 is supported by pairs of legs 71, so that the three horizontal plate assemblies 70 are disposed in a row in a common horizontal plane. The upper plate 66 has a plurality of small openings 72 communicating with the air chamber 68, and a stop piece 73 across from the picker 9. The three air chambers 68 communicate with one another via a suction pipe 74 disposed below the lower plate 67 so that when a vacuum (not shown) is in operation, the individual fly strip F is stably held on the horizontal plate assemblies 70 by suction.

Figure 7:
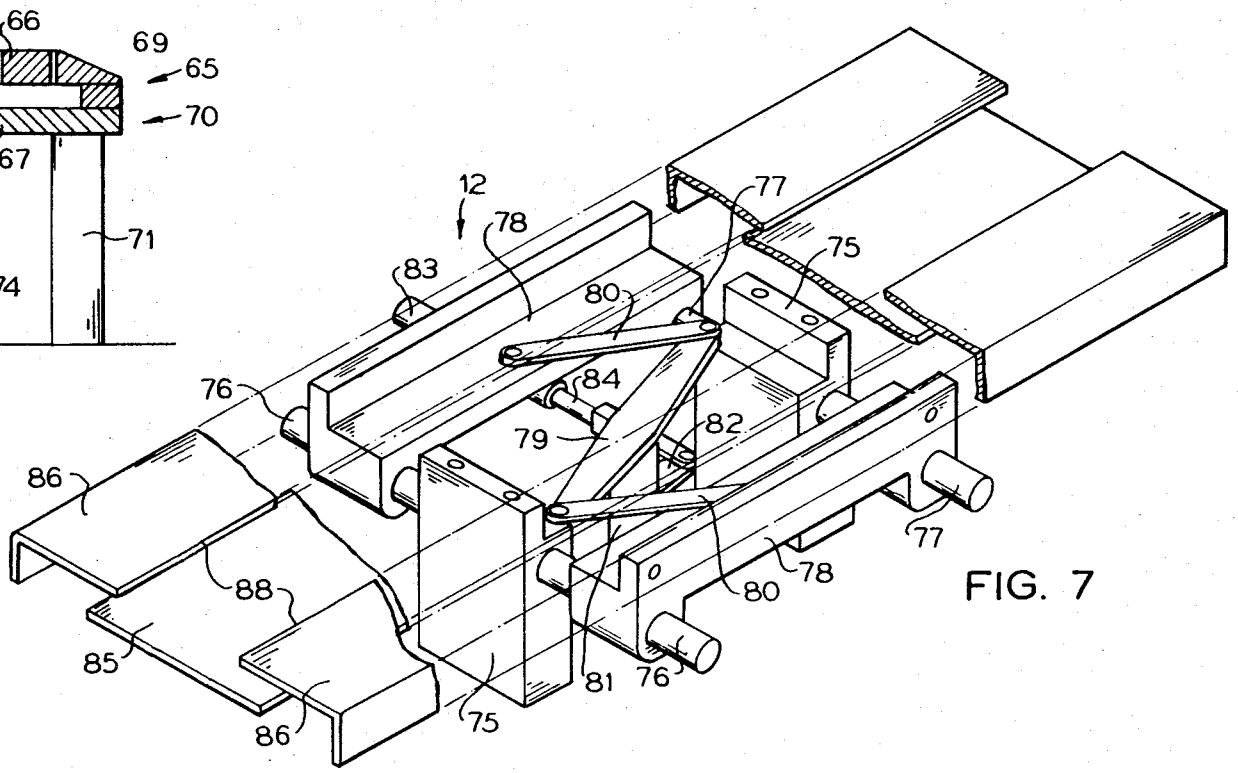
FIG. 7 is a perspective view, partially broken away, of a second feed table.

As shown in FIGS. 1, 2, and 7, the second feed table 12 is disposed on the table 14 in series with respect to the first feed table 10 with a small space between the two feed tables 10, 12. A pair of spaced base blocks 75 are mounted on the table 14, each base block 75 having a guide rod 76, 77 extending beyond opposite sides of the respective base block 75. A pair of slides 78 are slidably supported by the two guide rods 76, 77. The two slides 78 are relatively movably connected to one another via a lever 79 and a pair of links 80, 80 pivotally connected to the lever 79 at opposite ends. A shaft 81 rotatably mounted on the table 14 is secured at its upper end to a midportion of the lever 79. A radially extending arm 82 is mounted on the shaft 81 at its midportion and is connected at its free end to a piston rod 84 of a pneumatic cylinder 83. A guide plate 85 is secured to the upper face of the guide blocks 75 by means of machine screws (not shown). A pair of cover plates 86 having L-shaped cross-section are secured to the side faces of the slides 78, respectively, by means of machine screws 87 (FIG. 1) in such a manner that the cover plates 86 cover the guide plate 85 and also that the top faces of the cover plates 86 are level with the top face of the first feed table 10. Preferably, the respective confronting inner edges 88 of the two cover plates 86 are spaced apart from one another by a distance smaller than the width of the individual fly strip F. Accordingly, when the piston rod 84 of the pneumatic cylinder 83, is extended the two cover plates 86 are moved toward one another, sliding on the guide rods 76, 77. To the contrary, when the piston rod 84 is retracted, the two cover plates 86 are moved away from each other leaving a vertical opening facing to the guide plate 85, such that the second feed table 12 has two operating tiers.

As shown in FIGS. 2–3, the first feeder 11 is mounted on the table 14 in confronting relation to the picker assembly 9 with the first feed table 10 disposed between the first feeder 11 and the picker assembly 9. The first feeder 11 comprises a gripper 93 including upper and lower fingers 91, 92 having at their gripping ends a pair of leaf springs 89, 90, respectively. The four upper fingers 91 are supported by both a connecting plate 94 and two connecting rods 95, 95 in spaced relation to one another. The four lower fingers 92 are connected by the two connecting rods 96, 96 and are spaced from one another by a distance equal to the distance between the upper fingers 91. The four lower fingers 92 are supported by links 97 and are disposed slightly downwardly of the respective upper fingers 91. Preferably, the upper and lower fingers 91. 92 are disposed upwardly and downwardly, respectively, of the top face of the first feed table 10. A gripper holder 98 supports at its upper portion the gripper 93 via connecting rods 99 and is secured at its lower portion to the end of a piston rod 101 of a pneumatic cylinder 100 mounted on the table 14. Accordingly, in response to retraction of the piston rod 101, the gripper 93 is moved through the space between the table members 65 of the first feed table 10 and alongside the table members 65. And the gripper 93 returns to its original position in response to extension of the piston rod 101. In order to facilitate this movement of the gripper 93, a pair of guide rods 102 are fixed to the lower portion of the gripper holder 98 at opposite sides and guided by a pair of guide blocks 103, respectively. A pneumatic cylinder 106 is disposed between a bracket 104 mounted on the top of the gripper holder 98 and a projection 105 upwardly extending from one of the links 97. When a piston rod 107 of the pneumatic cylinder is retracted, the lower finger 92 of the gripper 93 is moved toward the upper finger 91. Reversely, when the piston rod 107 is extended, the lower finger 92 is moved away from the upper finger 91.

Figure 8:
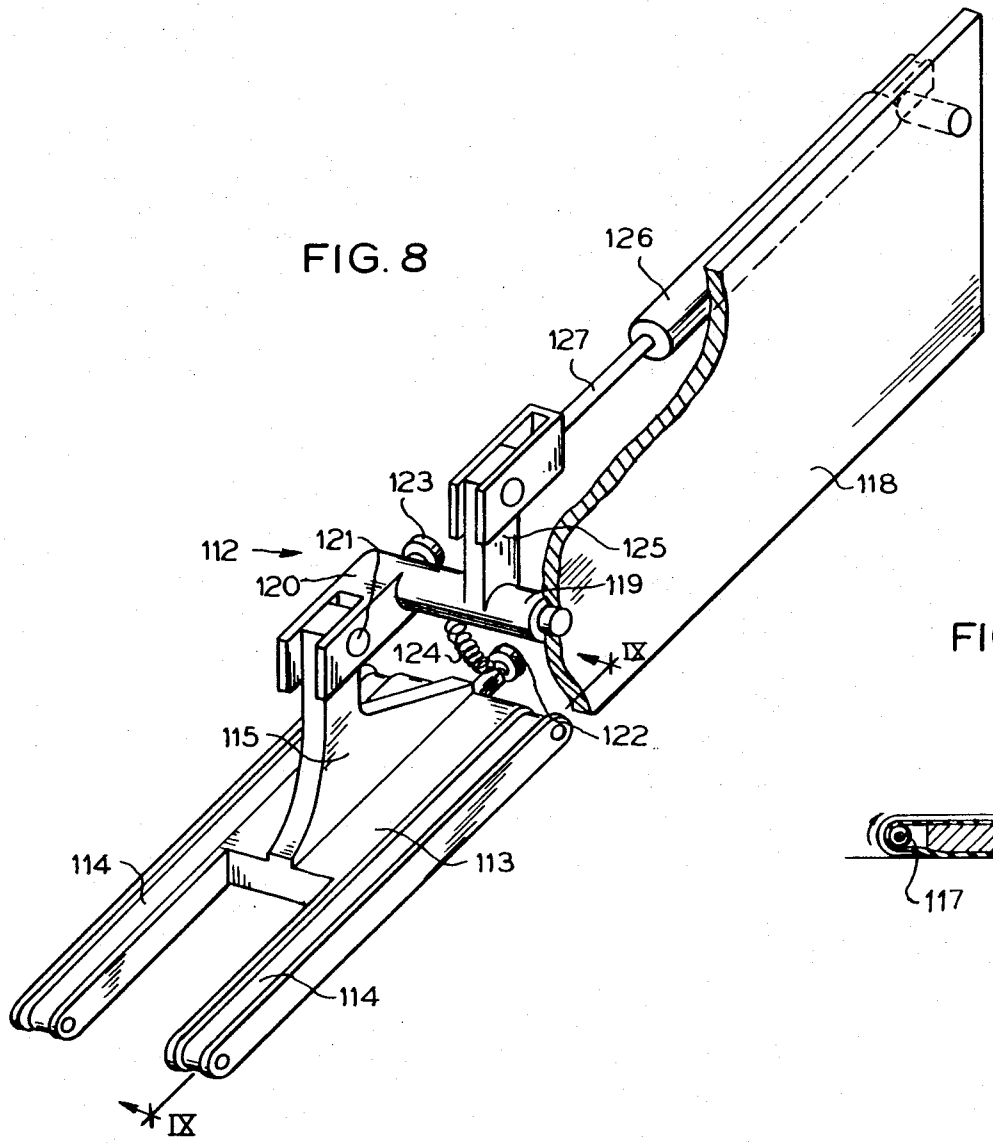
FIG. 8 is a perspective view, partially broken away, of a pusher unit.
Figure 9:
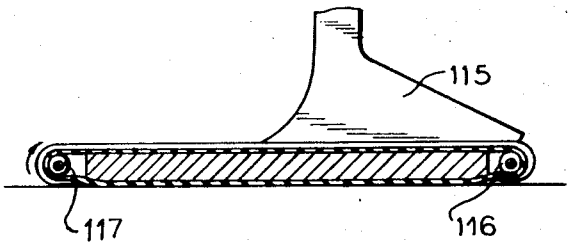
FIG. 9 is a cross-sectional view taken along line IX—IX of FIG. 8.

As shown in FIGS. 1–3 and 8–9, the second feeder 13 is disposed above and along the first and second feed tables 10, 12 for feeding the fly strips F on the first feed table 10 to the sewing machine 2 via the second feed table 12. A bracket 108 is disposed adjacent to the sewing machine 2. Four spaced rods 109 are supported by the bracket 108 and extend horizontally from an upper portion of the bracket 100, free ends of the rods 100 being connected by an end plate 110. Two of the four rods 109 are disposed adjacent to the first and second feed tables 10, 12 so that a slide 111 is slidable longitudinally of these two rods 109. A pusher unit 112 is mounted on the slide 111 at one side. As shown in FIGS. 8–9, a foot 113 of the pusher unit 112 has at opposite sides a pair of endless belts 114 and at its midportion a projection 115. Each belt 114 is moved about a roller 116 and a one-way clutch 117 so as to run only in the direction indicated by an arrow in FIG. 9, for a purpose described below. An upper end of the projection 115 is pivotally connected, by a pin 121, to a bifurcated projection 120 extending from a shaft 119 rotatably supported by a vertical plate 118. The axis of the pin 121 is slightly inclined with respect to the shaft 119 so that the direction in which the belts 114 run is inclined to that extent with respect to the second feed table 12, for a purpose described below. Preferably, the amount of inclination of the pin 121 is adjustable. A pair of bolts 122, 123 extends into one end of the foot 113 and a free end of the shaft 119, respectively. Between the two bolts 122, 123 an extension spring 124 is mounted in order to stabilize the position of the foot 113. A projection 125 extends upwardly from a midportion of the shaft 119, and is pivotally connected at its upper end to the end of a piston rod 127 of a pneumatic cylinder 126 pivotally mounted at one end on the vertical plate 118. Accordingly, when the piston rod 127 is extended, the foot 113 is lowered onto the cover plate 86 of the second feed table 12. Reversely, when the piston rod 127 is retracted, the foot 113 is raised from the cover plate 86. An interiorly threaded sleeve 128 is secured to the other side face of the slide 111, and threadedly engages a screw shaft 129 rotatably supported between the bracket 108 and the end plate 110. The screw 129 is operatively connected with a motor (not shown) via an electromagnetic clutch 131 mounted between the bracket 108 and another bracket 130 and also via a power transmission 132 fixed to the underside of the table 14. The power transmission 132 is operative to transmit rotation of the driving shaft of a non-illustrated motor to the screw 129, with or without changing the direction of that rotation by means of an electromagnetic clutch (not shown). The electromagnetic clutch 131 is operative to disconnect the screw 129 from the non-illustrated motor, thus stopping rotation of the screw 129. Thus with the power transmission 132 and the electromagnetic clutch 131, the screw 129 may be rotated in either direction, or may be kept from being rotated, as desired.

As shown in FIGS. 1, 3, and 10–11, the table 14, which supports the fly-strip supplier 3, is supported on an upper support 135 which includes a pair of side plates 133 connected by a pair of pipes 134 having a rectangular cross section. A pair of L-shaped guide rails 136 are secured to the underside of the table 14 by means of bolts. With the engagement between the rails 136 and the side plates 133, the table 14 is movable vertically (as viewed in FIG. 2) with respect to the support 135. A handle 137 is provided on the front of the table 14 in order to facilitate this movement of the table 14. A screw 138 extends from the handle 137 through a journal 139 fixed to the underside of the table 14, and then threadedly extends through a nut 140 fixed to the rectangular pipe 134. The accidental removal of the screw 138 is prevented by a pair of stop rings 141 disposed one on each side of the journal 139.

Figure 10:
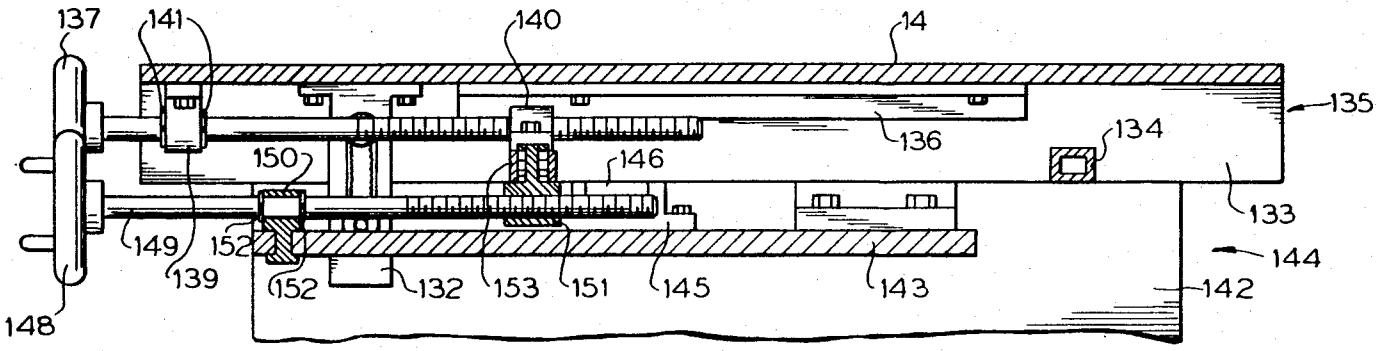
FIGS. 10 and 11 are cross-sectional views taken along lines X—X and XI—XI, respectively, of FIG. 1.
Figure 11:
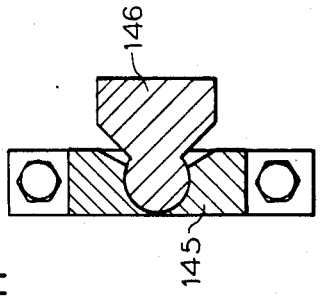

The upper support 135 is in turn supported on a lower support 144 which includes a pair of side plates 142 and a horizontal plate 143 extending between the two side plates 142. In FIG. 1, a pivot receptor 145 (FIG. 11) is fixed to the top of the horizontal plate 143 so as to be disposed under the second feed table 12. The pivot receptor 145 is receptive of a pivot 146 fixed to the underside of the upper support 135 so that the upper support 135 can be pivotally moved on the lower support 144 in the directions indicated by the arrows 147 (FIG. 2). Since the rectangular pipe 134 of the upper support 135 slides on the top surface of the right (as viewed in FIG. 1) side plate 142, this pivotal motion of the upper support 135 will take place stably and reliably. A handle 148 is provided on the front of the lower support 144 in order to facilitate this pivotal movement of the upper support 135. A screw 149 extends from the handle 148 through a journal 150 rotatably fixed to the horizontal plate 143, and threadably extends through a nut 151 fixed to the underside of the rectangular pipe 134. The accidental removal of the screw 149 is prevented by a pair of stop rings 152 disposed one on each side of the journal 150. As shown in FIG. 10, the nut 151 has a shaft 153 extending upwardly through the rectangular pipe 134, and is thereby rotatably mounted on the rectangular pipe 134. In FIG. 1, the sewing machine 2 is mounted on a plate 154 which is in turn fixed to the left side plate 142 of the lower support 144. The sewing station 155 of the sewing machine 2 is disposed adjacent to the second feed table 12, and is slightly inclined with respect thereto, as shown in FIG. 2.

As shown in FIGS. 1–3, the element-free gap forming unit or gapper 4, for forming a plurality of element-free gaps G devoid of coupling elements in the fastener chain C at uniform intervals of a predetermined distance, is disposed above the first and second feed tables 10, 12. The gap forming unit 4 is mounted on a post 157 fixed to the horizontal plate 143 and extending upwardly through an opening 156 of the table 14. The gap forming unit 4 may include a conventional punch unit 158, a die unit 159, a solenoid 160 for moving the punch unit 158, and a plunger 161 connecting the solenoid 160 with the punch unit 158. Any of these members of the gap forming unit 4 has a known construction, and therefore, its detailed description is omitted for clarity. In FIG. 1, a pair of spaced guide rollers 162, 162 is disposed at the right side of the punch unit 158 and die unit 159, and a chain feed roller 163 is disposed between the two guide rollers 162, 162. At the left side of the punch unit 158 and die unit 159 there are disposed a pair of upper and lower brushing roller 164,164 for brushing off the cut element leg portions left on the stringer tapes after gapping, a take-up roller 165, and pinch roller 166. The chain feed roller 163 is operatively connected to a motor 167 (FIG. 3) disposed rearwardly of the feed roller 163. The take-up roller 165 has a pulse generator (not shown) therein for producing pulses indicating the amount of rotation of the wheel 165 caused by movement of the zipper chain through the sewing station to control the operation of the gapping punch unit 158. The number of pulses that occur prior to energization of the punch 158 is determined by the length of the fly-pieces in the stack F. This length may be sensed each time the stacker is loaded by, for example, a measuring slide 165*a* driving a rotor 165*b* of the same diameter as wheel 165 providing a total pulse reading representing the length of the fly pieces and controlling the number of pulses at wheel 165 upon the occurrence of which the punch 158 is actuated. The fastener chain C having thus been gapped at the correct length is introduced into the sewing station 155 of the sewing machine 2 through a chain guide 168. At the sewing station 155 successive fly strips F are sewn one after another to the fastener chain C. The chain guide 168 is fixed to a free end of an arm 170 pivotally mounted on a casing of the sewing machine 2 by a pin 169.

Operation of the automatic apparatus will now be described. Although with the apparatus of the present invention it is possible to attach the fly strips F to the fastener chain C in various positions or orientations, a single mode of operation, in which the fly strips F are attached to the fastener chain C so as to be inclined with respect to the fastener chain C, is described below.

Figure 12:
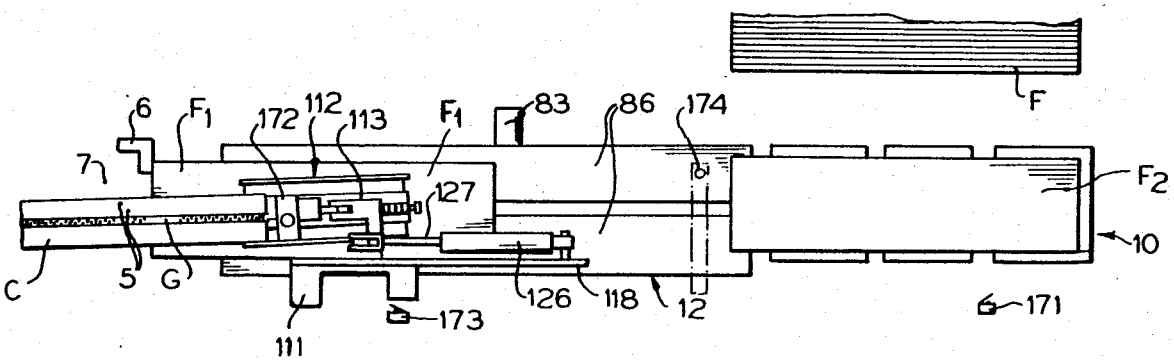
FIGS. 12 through 16 are schematic plan views illustrating a sequence of operations of the apparatus.

The position of the fly-strip supplier 3 with respect to the sewing station 155 of the sewing machine 2 is first set as desired by rotating the handles 137, 148 (FIG. 2). A continuous slide fastener chain C is introduced into the sewing station 155 through the gap forming unit 4 and the chain guide 168 in such a manner that one of the element-free gaps G is vertically aligned with the sewing needles 5 (FIG. 12). Meanwhile, as in FIG. 12, a stack of fly strips F is placed on the stacker 8, and a single fly strip $F_2$ is set on the first feed table 10. Also, another fly strip $F_1$ is placed on the second feed table 12; this fly strip $F_1$ is supplied to the sewing station 155 by the pusher unit 112 for being set with its leading end in alignment with the corresponding element-free gap G.

Figure 13:
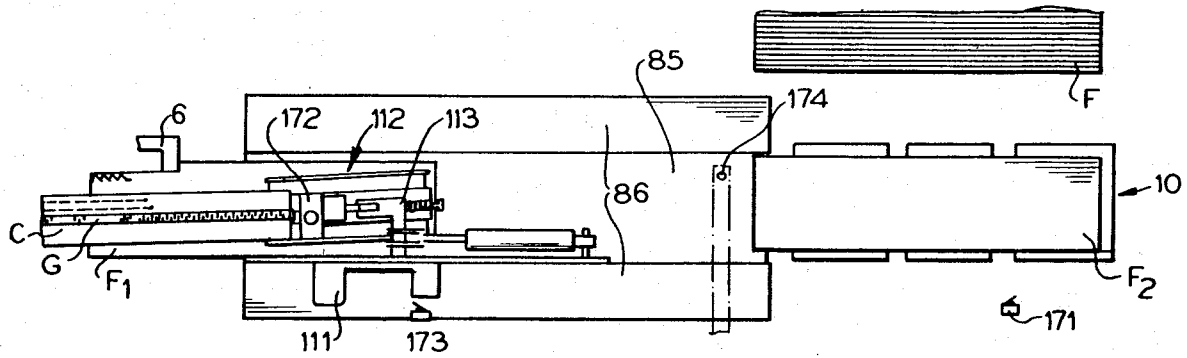

As the apparatus 1 is started the fly strip $F_1$ and the fastener chain C are sewn in superposed relation to one another, and at the same time, one side edge of the fly strip $F_1$ is overcast virtually simultaneously by being trimmed by the cutter 6 (FIG. 13). At that time since the belts 114 of the foot 113 race to the sewing station 155, the fly strip $F_1$ is reliably introduced into the sewing station 155, causing the belts 114 to run in the direction indicated by an arrow in FIG. 9.

Figure 14:
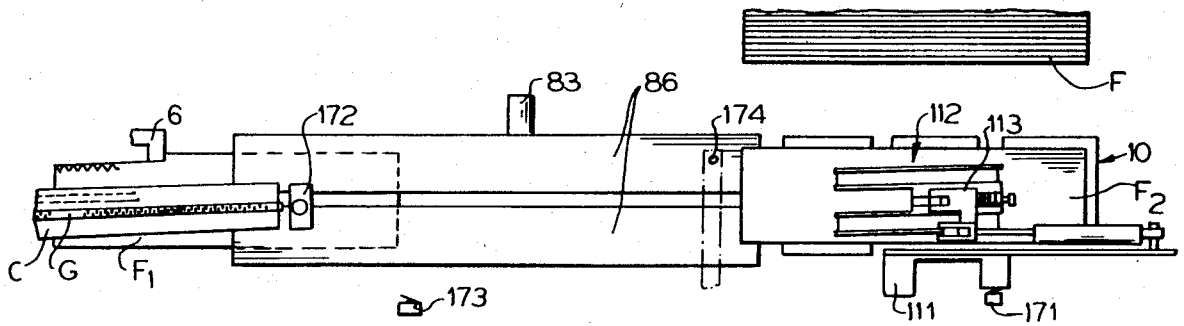

As the sewing progresses to some extent, a timer (not shown) is actuated (the timer is energized when the element-free gap G is sensed) whereupon the piston rod 127 of the pneumatic cylinder 126 is retracted, causing the foot 112 to rise. At the same time, as the piston rod 84 of the pneumatic cylinder 83 reciprocates, the cover plates 86 are opened (FIG. 13) and closed, thus allowing the fly strip $F_1$ to fall on the guide plate 85 and then covering the same fly strip $F_1$, as shown in FIG. 14.

After the foot 113 has been raised, a limit switch (not shown) is actuated to energize the electromagnetic clutch 131 (the power transmission 132 is in condition for reverse rotation, as described below). Accordingly, the pusher unit 112 is retracted to a position above the first feed table 10 and limit switch 171 is hit on its actuator by the slide 111 (FIG. 14).

The electromagnetic clutch 131 is thereby de-energized, and the power transmission 132 is in condition for rotation in the same direction as that of the motor's rotation, thus stopping the pusher unit 112. Concurrently, as the piston rod 127 of the pneumatic cylinder 126 is extended, the foot 113 is lowered onto the fly strip $F_2$ on the first feed table 10, and at the same time, a timer (not shown) is energized.

In response to actuation of the timer, the electromagnetic clutch 131 is energized, causing the pusher unit 112 to push the fly strip $F_2$ from the first feed table 10 to the second feed table 12.

Figure 15:
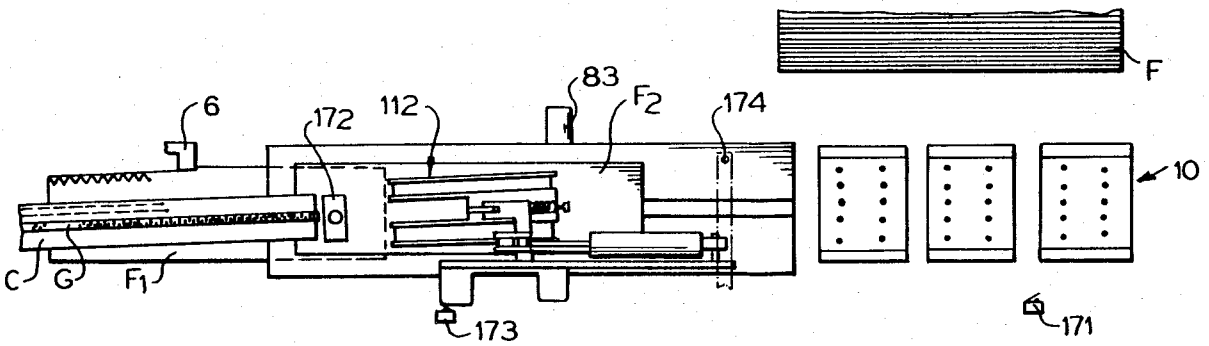

When the leading end of the fly strip $F_2$ is sensed by a sensor 172 (including a photoelectric transducer), the electromagnetic clutch 131 is de-energized, causing the pusher unit 112 to stop. The fly strip $F_2$ is thus stopped at that position. During that time, the limit switch 173 is hit on its actuator by the slide 111 (FIG. 15) at intervals.

When the limit switch 173 is hit on its actuator by slide 111 after the trailing end of the fly strip $F_2$ is sensed by the sensor 174, the piston rod 101 of the pneumatic cylinder 100 is retracted (FIG. 17), causing the gripper 93 to move toward the picker assembly 9 having picked the next fly strip $F_3$ and waiting. The gripper 93 hits the limit switch 175 on its actuator, and stops. As the gripper 93 is moved, a valve 176 (FIG. 2) is closed and chambers 68 of the feed table 10 are connected with suction.

Figure 17:
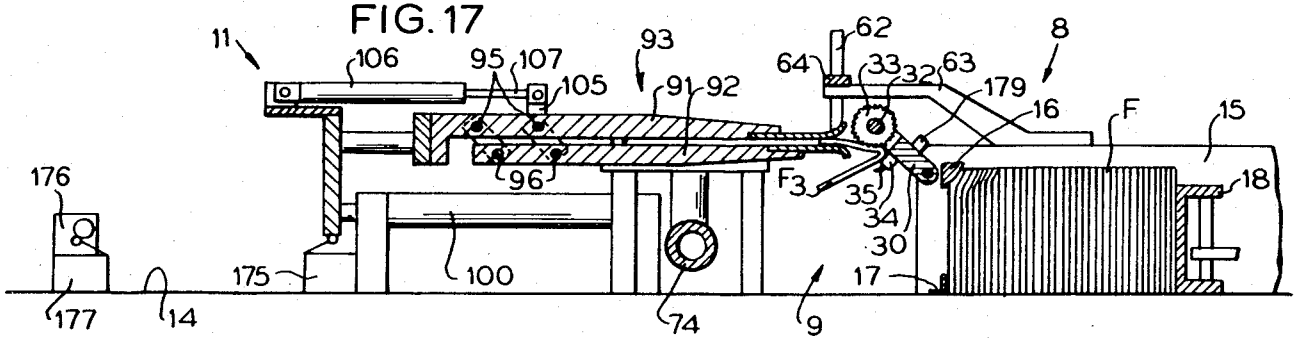

When the piston rod 107 of the pneumatic cylinder 106 is shrunk in response to actuation of the limit switch 175, the gripper 93 grips one side edge of the fly strip $F_3$ picked by the picker assembly 9 as shown in FIG. 17, and at the same time, the piston rod 43 of the pneumatic cylinder 42 is moved upwardly in FIG. 4, thus causing the picker wheel 33 to rotate clockwise in FIG. 17 to release the fly strip $F_3$. The limit switch 175 is hit on its actuator to energizer a timer (not shown).

Figure 16:
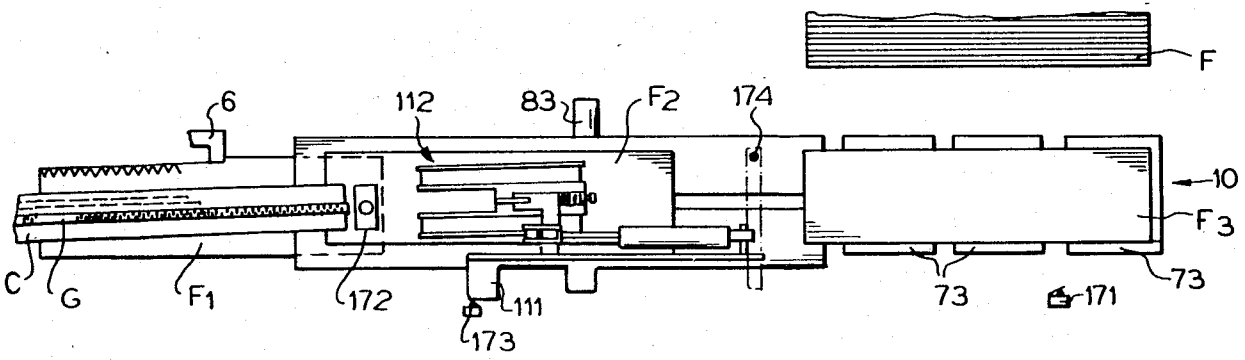
Figure 18:
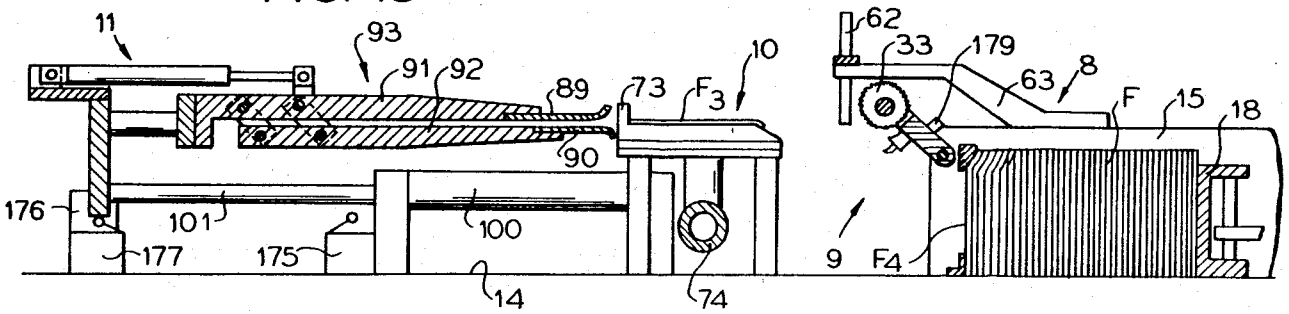

As the piston rod 101 of the pneumatic cylinder 100 is extended in response to actuation of the non-illustrated timer, the gripper 93 is retracted, hitting the limit switch 177 on its actuator and is then stopped. On the backward stroke of the gripper 93, the fly strip $F_3$ is engaged by the stop piece 73 of the first feed table 10 and is thereby released from the leaf springs 89, 90 of the fingers 91, 92, and is thereby deposited on the feed table 10 in flat condition, as shown in FIGS. 16, and 18.

As the gripper 93 is retracted, the guide rod 102 and the valve 178 (FIG. 2) are disengaged from one another to open the valve 178, thus allowing the piston rod 43 to return its original position. In response to retraction of the gripper 93, the valve 176 is opened by the gripper holder 98, terminating the suction of the first feed table 10.

Upon actuation of the limit switch 177, the piston rod 107 of the pneumatic cylinder 106 is extended, causing the gripper 93 to open. At the same time the non-illustrated timer is energized. Also upon actuation of the limit switch 177, the piston rod 29 of the pneumatic cylinder 28 for the fly-strip stacker 8 is extended, indexing the fly strips F against the upper and lower stop bars 16, 17. Further upon actuation of the limit switch 177, the piston rod 52 of the pneumatic cylinder 51 is retracted, causing the swing plate 30 to be pivotally moved downwardly until it abuts the leading surface of the uppermost fly strip $F_4$ of the fly strip stack.

Figure 19:
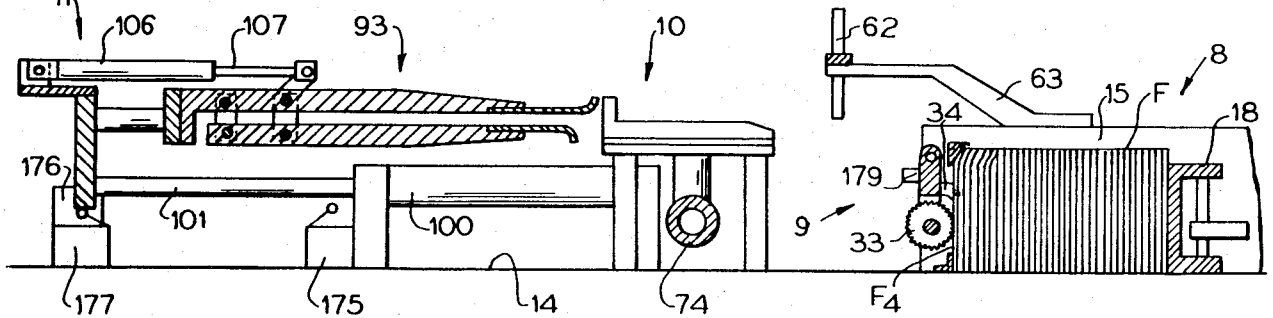

Subsequently, when the non-illustrated timer is energized in response to actuation of the limit switch 177, the piston rod 43 of the pneumatic cylinder 42 is lowered, causing the picker wheel 33 to rotate counterclockwise as viewed in FIG. 19. Thus the fly strip $F_4$ is sandwiched between the picker wheel 33 and the picker piece 34.

A discrimination between front and reverse sides of the fly strip F is afforded by the inventive apparatus. If the side of the fly strip F that faces a sensor 179 (e.g., a photoelectric sensor) is the front, such as denoted by exterior finishing or different shading with colored fabrics, the piston rod 60 of the pneumatic cylinder 59 for the stop mechanism 54 (FIGS. 1 and 2) is retracted, the long stop bolt 57 being held so as to abut the stop block 61. To the contrary, if the side of the uppermost fly strip F that faces the sensor 179 is the reverse, the piston rod 60 is extended, the short stop bolt 58 being held so as to abut the stop block 61. Typically, in the manufacture of jeans parts, successive fly strips are usually stacked in such a manner that every other fly strip is disposed front side down.

In case the front and reverse of the fly strip material cannot be reliably detected electronically, an alternating switch may be provided, overriding the sensor. Similarly, if all fly pieces are stacked with the same side up, the sensor may be overridden and the appropriate stop selected.

Figure 20:
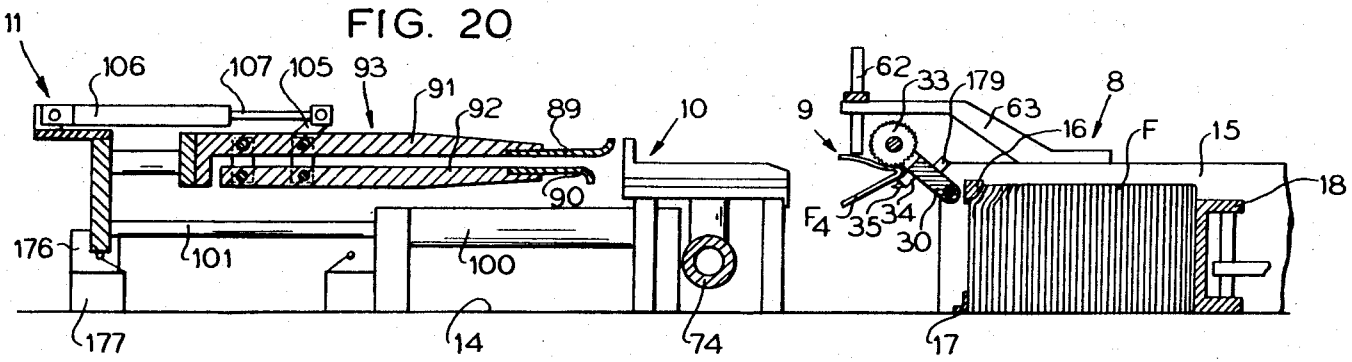
FIGS. 17 through 21 are cross-sectional views illustrating the manner in which a picker assembly and a first feeder operate.
Figure 21:
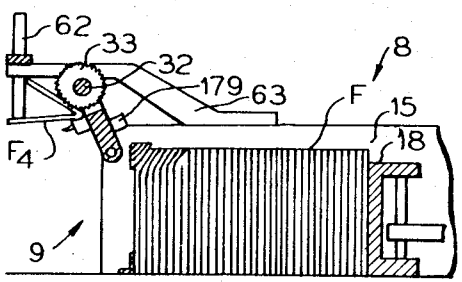

When the non-illustrated timer is energized in response to actuation of the limit switch 177, the piston rod 52 of the pneumatic clylinder 51 for the fly strip stacker 8 is extended until the stop block 61 strikes the stop bolt 57. The swing arm 30, with the fly strip $F_4$ picked thereby, is turned clockwise in FIG. 20, and stops and waits with one side edge of the fly strip $F_4$ touching the stop pin 62, such that the fly strip $F_4$ will have been reoriented 90° about its linear axis when deposited on the first feed table 10. If the leading or uppermost fly strip $F_4$ is placed reverse side up, the piston rod 52 is extended until the short stop bolt 58 strikes the stop block 61. The swing arm 30 stops and waits with the other side edge of the fly strip $F_4$ touching the stop pin 62 as shown in FIG. 21, such that the fly strip $F_4$ will have been reoriented 270°, about its linear axis when deposited on the first feed table 10.

During the operations above, the element-free gap G of the fastener chain C is sensed by a senser 180 (such as a photoelectric transducer). The electromagnetic clutch 131 is thereby energized, and the pusher unit 112 is advanced thus supplying the fly strip $F_2$ again to the sewing station 155 in such a timed relation that the leading end of the fly strip $F_2$ is aligned with the corresponding element-free gap G.

In response to energization of the non-illustrated timer, the electromagnetic clutch 131 is de-energized, and the power transmission 132 is in condition for reverse rotation.

The preceding steps are repeated for each fly strip obtained from the stacker 8 for sequential, continuous operation of the apparatus 1.

The apparatus of the present invention may be used to attach the fly strips to either a pre-gapped fastener chain or a non-gapped fastener chain. To set pre-gapped fastener chain, it is directly threaded through the chain guide 168 and is then introduced into the sewing station 155. To set the non-gapped fastener chain, it is introduced into the sewing station 155 via the guide rollers 162,162 the chain feed roller 163 and the chain guide 168. In the latter case, the photoelectric sensor 180 does not work.

Although various minor modifications may be suggested by those versed in the art, it should be understood that I wish to embody within the scope of the patent warranted hereon all such modifications as reasonably and properly come within the scope of my contribution to the art.

I claim as my invention:

1. Apparatus to feed from a stack individual fly strips to a sewing machine for attaching said fly strips to continuous slide fastener chain, comprising a stacker means in which a series of fly strips are disposed one behind the other in a stack, a picker means for grasping the foremost fly strip in said stack intermediately of its face surface and rotating said foremost fly strip outward from said stack, a feed table means leading to said sewing machine, a feed finger means for retrieving each fly strip grasped and rotated by said picker means and releasing it onto said feed table means, and a pusher means for advancing each fly strip along said feed table means, wherein said picker means comprises a claw arm disposed for pivotable rotation adjacent the foremost end of said stack to frictionally hold a portion of said fly strip face surface and a wheel positioned on said claw arm and driven for rotation for grasping a portion of said fly strip face surface relative to said claw arm, causing said foremost fly strip to fold over itself.

2. The apparatus of claim 1, wherein said claw arm may be selectively driven through first and second different angles of rotation during different cycles of said picker means.

3. The apparatus of claim 2 including means sensing the orientation of the foremost fly strip and means controlling selection of said first and second angles in response to said sensing.

4. The apparatus of claim 2 wherein said picker means includes an adjustable stop means for locating each grasped fly strip for retrieval by said feed finger means.

5. The apparatus of claim 1, wherein said feed table means includes a two-tiered table in which a first tier surface overlies a second tier surface, said first tier surface comprising retractable plate means for exposing said second tier surface therebeneath, said first tier surface receiving each said fly strip and passing it to said second tier surface for pick-up by said sewing machine while said first tier surface prepares to receive the next fly strip.

6. The apparatus of claim 1, wherein said pusher means is adapted for back and forth movement over and along said feed table means and movable between a lowered position for engaging each said fly strip during a forward movement along said feed table means and a raised position during a return movement along said table means.

7. The apparatus of claim 6, wherein said pusher means has a fly strip engaging surface formed an belt means having a one-way clutch such that said fly strip is movable beneath said belt means in one direction only.

8. Apparatus to feed from a stack individual fly strips to a sewing machine for attaching said fly strips to continuous slide fastener chain, comprising a stacker means in which a series of fly strips are disposed one behind the other in a stack, a picker means for grasping the foremost fly strip in said stack intermediately of its face surface and rotating said foremost fly strip outward from said stack, a feed table means leading to said sewing machine, a feed finger means for retrieving each fly strip grasped and rotated by said picker means and releasing it onto said feed table means, and a pusher means for advancing each fly strip along said feed table means wherein said feed table means includes a two-tiered table in which a first tier surface overlies a second tier surface, said first tier surface comprising retractable plate means for exposing said second tier surface therebeneath, said first tier surface receiving each said fly strip and passing it to said second tier surface for pick-up by said sewing machine while said first tier surface prepares to receive the next fly strip.

* * * * *